United States Patent [19]

Weber et al.

[11] Patent Number: 4,508,596

[45] Date of Patent: Apr. 2, 1985

[54] APPARATUS FOR DRY COOLING OF COKE

[75] Inventors: Heinrich Weber, Recklinghausen; Kürt Lorenz, Hattingen; Horst Dungs, Herne; Engelbert Brüns, Recklinghausen; Gerd Osterholt, Dorsten, all of Fed. Rep. of Germany

[73] Assignee: Firma Carl Still GmbH & Co. KG, Fed. Rep. of Germany

[21] Appl. No.: 458,269

[22] Filed: Jan. 17, 1983

[30] Foreign Application Priority Data

Jan. 28, 1982 [DE] Fed. Rep. of Germany ..... 3202645

[51] Int. Cl.[3] ..... C10B 39/00; C10B 39/16; C10B 45/00

[52] U.S. Cl. ..... 202/227; 202/228; 202/263; 202/269; 414/287; 414/291

[58] Field of Search ..... 202/227, 228, 239, 262, 202/263, 266, 269, 270; 201/39–41; 414/287, 288, 291, 292, 301–303

[56] References Cited

U.S. PATENT DOCUMENTS

| | | | |
|---|---|---|---|
| 4,009,081 | 2/1977 | Ueda et al. | 202/262 |
| 4,286,912 | 9/1981 | Galow et al. | 414/287 |
| 4,345,867 | 8/1982 | Minasov et al. | 202/227 |
| 4,358,345 | 11/1982 | Lorreck | 202/228 |

FOREIGN PATENT DOCUMENTS

| | | | |
|---|---|---|---|
| 3004175 | 8/1981 | Fed. Rep. of Germany | 202/228 |
| 123285 | 7/1982 | Japan | 202/228 |
| 111379 | 7/1982 | Japan | 202/227 |
| 0518961 | 7/1978 | U.S.S.R. | 202/228 |

*Primary Examiner*—Bradley Garris
*Attorney, Agent, or Firm*—McGlew and Tuttle

[57] ABSTRACT

A method for the dry cooling of coke comprises transferring the coke from the coke oven to a special bucket which is moved over a charging hole of a cooling pit. The space between the bucket and the charging hole is closed off and sealed against the atmosphere and a shutter which closes the top of the charging hole is moved upwardly and then transversely off the charging hole to open it as an intermediate charging guide piece is moved in position between the hole and the bucket for the transfer of the coke therebetween. The space between the bucket and the charging hole is sealed by a frame of a sluicing device in which the shutter and the intermediate charging hole guidepiece is movable. The device advantageously runs on wheels which are located outside the frame which seals the space between the charging bucket and the charging pit. The frame of the sluicing device advantageously includes a sealing element which engages into a recess seal combined around the charging hole.

8 Claims, 3 Drawing Figures

1
2
3
4
5
6
7
8
9
10
11
12
13
14
15
16
17
18
20
21

APPARATUS FOR DRY COOLING OF COKE

FIELD AND BACKGROUND OF THE INVENTION

This invention relates in general to coke ovens and in particular to a new and useful method and apparatus for effecting the dry cooling of coke.

The invention relates to a method for the dry cooling of coke, where the red hot coke is transported by a special bucket from the coke oven to the cooling pit and is cooled therein, to which end the bucket is placed on the cooling pit and is then emptied into the cooling pit through a sluice consisting of a housing which receives the shutter, charging hole and intermediate piece. The invention further relates to a cooling pit with outflow tunnel (hopper) for the special bucket and with a sluice arranged on the charging hole, for carrying out the method, the sluice comprising a housing which receives the intermediate piece and a shutter and is contiguous to the charging hole.

The so called dry cooling of coke leads to a considerable reduction of pollution when quenching the red hot coke. To this end the red hot coke is transported by means of a special bucket from the coke oven to the quenching system, the special bucket being closed during the transport. The special bucket is placed on the cooling pit and the coke is dropped into the cooling pit by opening the bottom of the bucket. To prevent hot gases and dust from streaming out during this process, a special sluice is used for closing the cooling pit.

Raisable and lowerable as well as laterally movable shutters for cooling pits are known in principle (German OS No. 30 04 175.9), the shutter including the wheels and an intermediate piece arranged in a closed housing. On the rails, in the region of the shutter, depressions are provided, into which wheels engage in the closed state of the shutter. Naturally, due to this design, only a limited raising and lowering of the shutter is possible. Hence the sealing effect of the shutter is dependent on additional measures. Moreover, it is disadvantageous that the housing closed on all sides has a great space requirement and must be sealed to the extent that escape of gases is prevented with certainty. If the gases are evacuated from the housing, it is disadvantageous that the housing has so large a volume. Moreover, the wheels over which the shutter is transported back and forth must be adapted to the high requirements within the closed slide (valve) housing, whih requires the use of special material. Especially disadvantageous are the expensive dimensions of the housing, which result from the fact that the wheels and the rails as well as the actual shutter and the intermediate piece are arranged inside the housing, the shutter and intermediate piece being pushed back and forth and lifted in the housing.

SUMMARY OF THE INVENTION

The invention provides a method for the cooling of coke free from emissions even during the necessary openings of the cooling pit and to minimize the suction space required therefor.

According to the invention, after the placing on a special bucket, the intermediate piece and shutter are moved jointly and in so doing are covered and largely sealed against the atmosphere, and gases released from this tightly enclosed space, when opening the charging hole are evacuated.

The method of the invention offers the possibility, with a sluice of minimum volume, nevertheless, to securely collect and remove the gases issuing when the cooling pit is opened. The charging process of the cooling pit is thus free from emissions, thereby further contributing to reducing environmental pollution. The shutter and the intermediate piece can be moved back and forth and raised and lowered, with the housing which encapsulates these parts, i.e. the sluice, having a very small volume.

According to another embodiment of the invention, it is provided that the intermediate piece is encapsulated at the truck contiguous to the shutter. Such an encapsulation reduces the volume of the sluice further, yet ensures an effective evacuation during the period characterized by the presence of emissions from the cooling pit.

For the practice of the method and for the solution of the problem with respect to the housing with smallest possible volume, a cooling pit is proposed wherein the housing frame which encapsulates the shutter and intermediate piece is designed to be movable together with the shutter and intermediate piece wholly or partly. Such a housing is adapted to the dimensions of the shutter and intermediate piece irrespective of the displacement path, so that its volume is corespondingly small. Due to this smallest possible space, both the expense of construction as well as operating expense with respect to evacuation is low.

According to an expedient development of the invention, the side walls of the housing frame which are contiguous to the horizontal housing cover and bottom associated with the hopper and charging holes are correlated with the shutter and intermediate piece and movable with them. In an advantageous manner a housing is provided which acts as sluice of smallest possible volume, and is structurally easy to realize and which nevertheless encapsulates the area around the charging hole effectively, sealing it from the atmosphere when the shutter is opened.

To be able to construct also the wheels simply and inexpensively and to make them at the same time more easily accessible, it is provided according to the invention that the side walls are correlated with the truck which carries the intermediate piece and shutter so as to recess the wheels thereof and the rails. The rails and the wheels running on them thus lie outside the housing, are not stressed by the issuing gases, and are easy to service as they are readily accessible.

A sufficiently tight seal between the side walls, which move back and forth, and the housing cover and housing bottom, can expediently be achieved in that the side walls and housing cover and housing bottom have angle irons at the edges facing each other. Through the angle irons a larger contact and sealing surface is created. It is possible also to form the side walls and housing cover and housing bottom appropriately beveled in the region of the edges, in order thus to create contact or sealing surfaces.

According to another development of the invention, the side walls have, at the edges facing the housing cover and bottom, sealing elements sliding thereon. As these sealing elements are not exposed to pressure or other loads, they are subject to only little wear and lead to optimization of the seal if it should turn out that the intake of ambient air is unfavorable or harmful.

Rapid lifting of the shutter, which is uniform in all regions, and accordingly also the lowering after conclusion of the charging process, is assured according to the invention because the shutter is raisable and lowerable through a spindle drive, which may be coupled with the shifting drive. Advantageous in this connection is, in particular, that such a spindle drive requires little space and can be arranged and designed to fit prevailing conditions without requiring any appreciable structural expense. By the coupling to the shifting drive continuous synchronous operation is ensured and unintentional damage to the shutter by premature actuation of the shifting drive is prevented with certainty. Besides, such drives can be designed so that they can be used for both functions successively.

Because of the spindle drive and the arrangement of the rails next to the charging hole it is possible to raise and lower the shutter sufficiently, so that in an advantageous manner an immersion seal or the like may be used. To this end it is provided according to the invention that at the edge of the shutter a cant plate is arranged in a revolving and adjustable manner. By the displaceable arrangement it is possible to adapt such a shutter to the prevailing conditions. A universal shutter is thus created, thereby contributing to a reduction of stockkeeping. In addition, a good sealing effect without special compressive forces exists. An advantageous light construction of the shutter consists of fireproof mats.

The invention has the special feature that a method and a shutter for cooling pits of the dry cooling of coke is provided through which an effective seal at optimum structural dimensions exists. Because of the low overall height and due to the side walls of the housing movable with the shutter and the intermediate piece, the housing or respectively the sluice has a small volume. This leading, at the same time, to a reduction of the operating costs. The special design and arrangement of the side walls of the housing makes it possible to dispense with a far overhanging construction for the encapsulation of the shutter and of the intermediate piece. The accessories of the truck lie outside the housing and are therefore largely protected against the issuing gases and against heat.

Further details and advantages of the subject of the invention will be evident from the following description of the respective drawing, in which a preferred embodiment is illustrated with the necessary details and separate parts.

Accordingly, it is an object of the invention to provide an improved method for dry cooling coke which comprises transferring the coke in a bucket from the coke oven to a cooling pit having a charging hole over which the bucket is positioned, closing off and sealing the space between the bucket and the charging hole against the atmosphere and moving a shutter which closes the charging hole in the closed off space off the top of the hole to open it as an intermediate charging hole guide piece is simultaneously moved in the closed off space to position it between the opened charging hole and the bucket to provide a shield and guide between the bucket and the charge hole. The closed off space is advantageously connected to suction devices for drawing off the gases and ashes.

A further object of the invention is to provide a device for transferring coke from a transfer bucket to a charging hole which comprises means for closing off the space therebetween and for effecting the shipping of a shutter and a guide frame alternatively between a position closing off the charge hole to one in which the guide plate is positioned between the bucket and the charge hole for the guidance of coke therebetween.

A further object of the invention is to provide a device for transferring hot coke which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
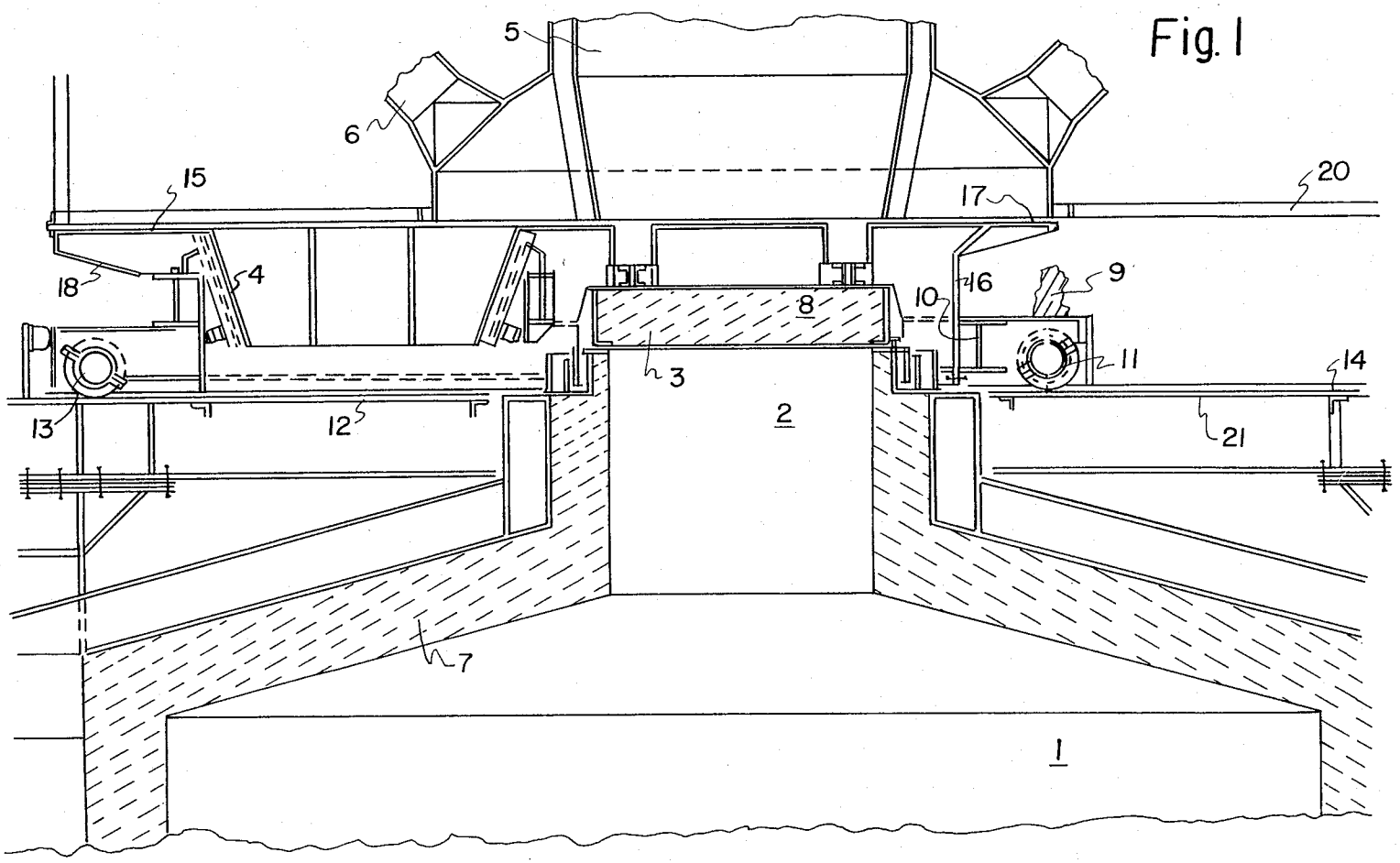
FIG. 1 is partial sectional view of a cooling pit with a device for transferring hot coke from a hopper to the cooling pit constructed in accordance with the invention.

Referring to the drawings in particular the invention embodied therein comprises a method for the dry cooling of coke which is first transferred to a hopper 5 which is positioned with its bottom transfer opening overlying the charging hole 2 of a cooling pit 1. The space between the hopper 5 and the cooling pit is sealed off from the atmosphere by a sluicing device or truck which includes a frame which defines a space between the bucket and the charging hole which is closed off from the atmosphere. In accordance with the invention, a closing member or shutter 3 is mounted within the frame for up and down movement as well as transverse movement and after it is lifted off the charging hole to open the charging hole, it is shifted transversely simultaneously with the movement of an intermediate guide piece 4 which is positioned then between the opened charging hole and the hopper 5 to guide the coke from the hopper into the charging hole.

FIG. 1 shows the upper region of a cooling pit 1, which terminates in the charging hole 2, which in the position shown in FIG. 1 is sealed from the atmosphere through the shutter 3. Above the cooling pit 1 or charging hole 2 is the hopper 5, through which the red hot coke is charged into the cooling pit 1. During charging, the shutter 3 is raised and moved to the side, while at the same time the intermediate piece 4 reaches the position of shutter 3, thereby closing the transitional region between hopper 5 and charging hole 2. Laterally of the hopper 5, suction pipes 6 are indicated. The gases flowing out when the cooling pit is opened are sucked up and evacuated through the suction pipes 6, these being connected with the housing frame 9 which encapsulates or surrounds shutter 3 and intermediate piece 4.

The cooling pit 1 is provided with a lining 7 which extends up into the region of the charging hole 2. Also the shutter 3 itself is provided with a corresponding insulation 8. Because of the light construction it is easy to handle.

The shutter 3 and intermediate piece 4 are associated with a common truck 10, which has several, preferably four, wheels 11, 13 which in turn can run on the rails 12, 14. As can be seen from FIGS. 1 and 2, the wheels 11 and 13 are arranged outside the covering provided by the side walls 15, 16, 17, 18. Also the rails 12, 14 themselves are not included in the region formed by the housing frame 9, in order to safely remove the gases issuing when the shutter 3 is opened and then to evacuate them. The construction of truck 10 will be explained in greater detail below with reference to FIG. 3.

Figure 2:
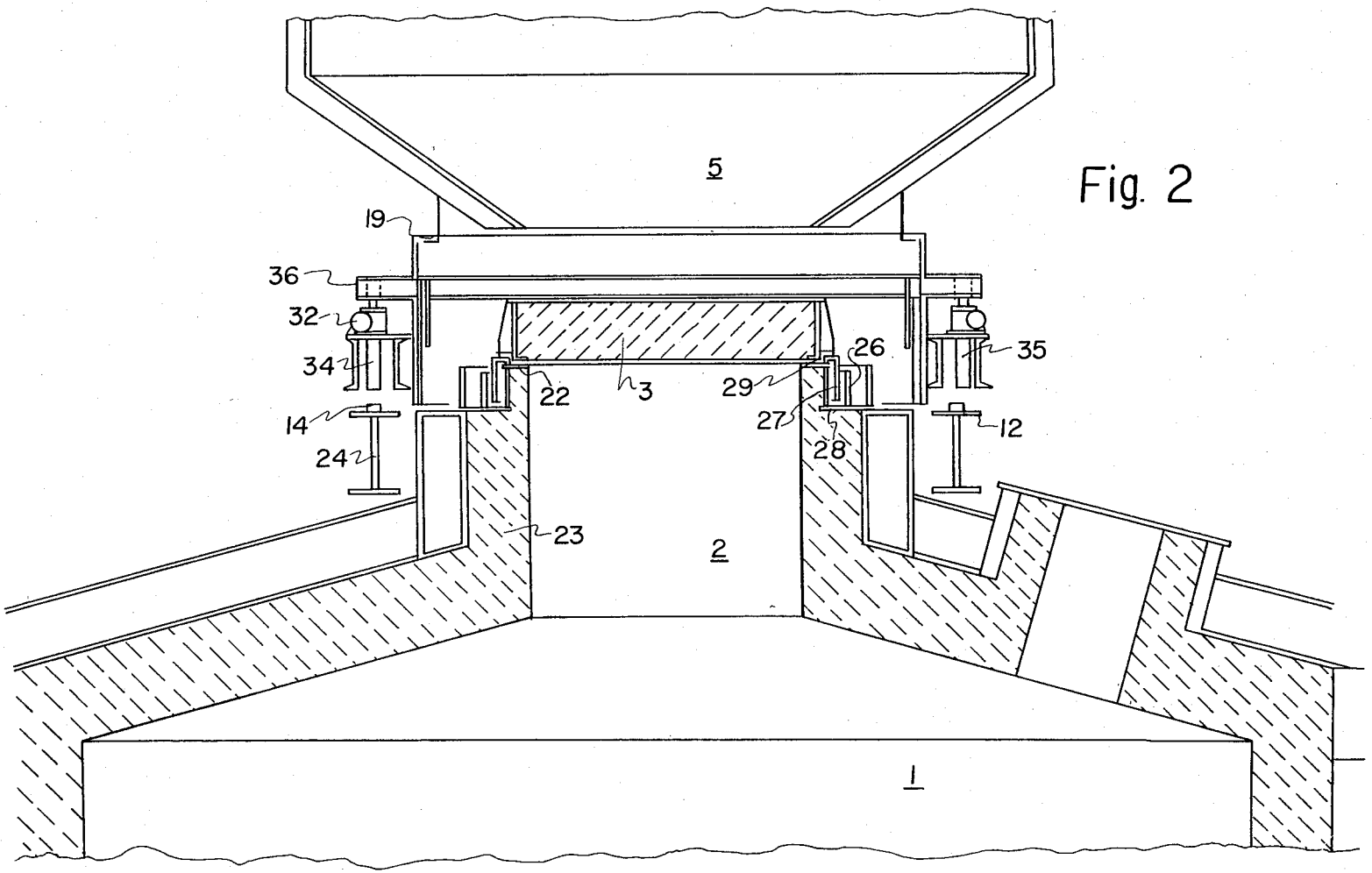
FIG. 2 is a transverse section of the cooling pit shown in FIG. 1.

FIG. 2, taken as a section crosswise to the travel direction of truck 10, illustrates how the edge (rim) 19 or respectively the the edges of the side walls 15, 16, 17, 18 are placed in or at the housing cover 20 and housing bottom 21, respectively. Housing cover 20 is associated with hopper 5, while the housing bottom 21 is associated with the cooling pit 1 or respectively with the charging hole 2. By joint action the side walls 15,16, 17,18 and the housing cover 20 and bottom 21 form a housing which due to its small volume can be kept free of gases and also by evacuation at little expense. The drawing in of outside air into the housing is effectively prevented by the special design of the upper edge 19, i.e., the edges of the side walls 15, 16, 17, 18. FIG. 2 further illustrates how exactly the shutter 3 and appertaining parts can be cut to size, because inclusion of the wheels 11, 13 and other parts important for moving shutter 3 into the seal effected through the side walls can be dispensed with.

Figure 3:
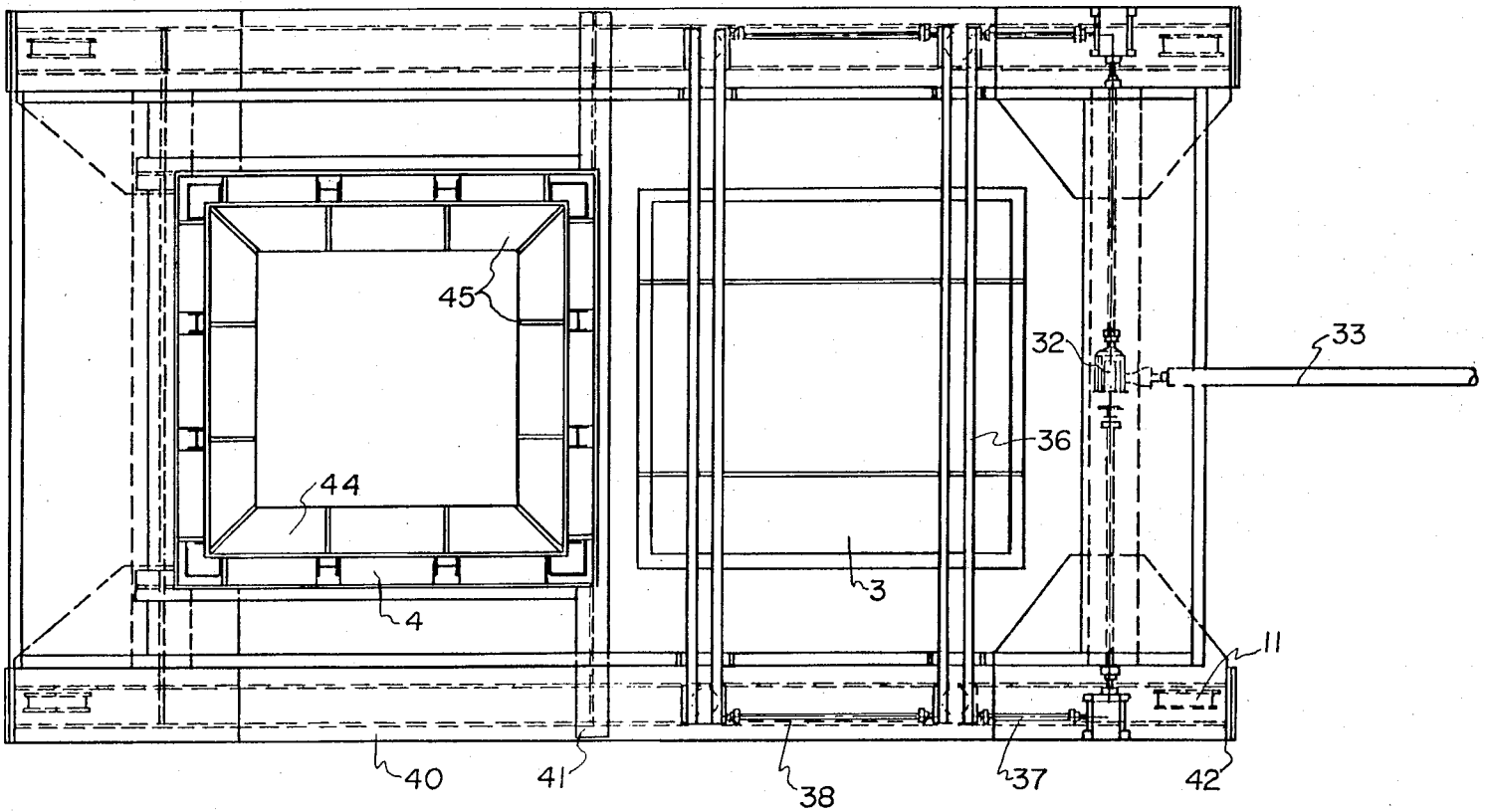
FIG. 3 is a top plant view of the transferring sluice used for transferring the hot coke in accordance with the invention.

The rails 12 and 14 run parallel to the charging hole 2 below the actual shutter 3 (FIG. 3). The rails 12, 14 are provided on the upper flange of the double T-sections 24, ensuring even rolling of the wheels 11, 13. According to FIG. 2, the rails 12, 14 are disposed below the edge 22 of the charging hole 2 and parallel to the wall 23 thereof. This gives the system sufficient lift height for shutter 3, so that an immersion seal 26 can be employed which ensures optimum seal of the cooling pit in the closed state. For this purpose, there are arranged at the lower edge of shutter 3 cant plates 27, which are introduced by their free end 28 into the immersion seal 26. On the side opposite the free end 28 the cant plate 27 is canted twice, so that a free edge 29 is formed which rests exactly on the edge 22. Through this free edge 29 and the immersion seal 26 the mentioned optimum closure of the cooling pit 1 is effected.

For the raising and lowering of shutter 3 a spindle drive 32 is used, which in the example shown is combined with the shifting drive 33. Through the spindle drive 32, the spindles 34, 35 are actuated, which then raise the shutter 3 secured to the support strips 36 or insert it into the seat, i.e. into the immersion seal 26. For this purpose the spindle drive 32 has the linkage 37, 38 in order to lift or lower the shutter 3 simultaneously and evenly at all four corners.

Shutter 3 and intermediate piece 4 are associated with one and the same truck 10, as has been mentioned before. This truck 10 comprises the longitudinal girders 40, on which the wheels 11, 13 are fastened, and the traverse girders 41, on which the shutter 3 or respectively the intermediate piece 4 is fastened. Through a wheel guard 42 it is assured that the individual wheels 11, 13 are extensively protected from dirt and the like.

Upon actuating the spindle drive 32 and linkage 37, 38 first shutter 3 is raised and then pulled away from the charging hole 2 through the shift drive 33. Since shutter 3 and intermediate piece 4 are assigned to the same truck 10, with the moving of shutter 3 the intermediate piece is simultaneously pulled into this region and thus effectively covers this region as the coke falls through. During the intermediate stages, especially the side walls 15,16,17,18 provide for a safe removal and evacuation of the gases flowing out the charging hole 2, cooperating with the housing cover 20 above and the housing bottom 21 below, respectively, forming the mentioned sluice. The housing bottom 21 is provided between rails 12,14 so that the lower edges of the side walls 15, 16,17, 18 can slide on it tightly.

The inner walls 44 of the intermediate piece 4 are arranged slanting inward and downward, so that a rectangular or square hopper 45 is formed. Uniform passage of the red hot coke is thus ensured. The special design of the intermediate piece 4 and of the connection between intermediate piece 4 and shutter 3 is illustrated by FIG. 3.

While a specific embodiment of the invention has been shown and described in detail to illustrate the application of the principles of the invention, it will be understood that the invention may be embodied otherwise without departing from such principles.

What is claimed is:

1. In combination with a transfer hopper associated with a housing cover, and a coke cooling pit having a charging hole and associated with a housing bottom spaced from said housing cover, a device for transferring hot coke from said transfer hopper to said charging hole, comprising:

rail means spaced from said charging hole and defining a lateral path;

a frame mounted for movement between said housing cover and said housing bottom for movement along said lateral path;

a plurality of connected side walls connected to said frame and movable with said frame along said lateral path, said side walls defining a housing space spanning a distance between said housing cover and said housing bottom for substantially closing said housing space and maintaining said hosing space closed with movement of said frame on said lateral path;

a charging hole closing shutter mounted to said frame and in said housing space;

shutter drive means connected between said frame and said shutter for moving said shutter upwardly and downwardly with respect to said frame;

an intermediate coke guide piece connected to said frame and disposed in said housing space for spanning a distance between said transfer hopper and said charging hole for guiding hot coke from said transfer hopper to said charging hole, said guide piece spaced lateraly of said shutter along said lateral path; and a plurality of wheels rotatably mounted to said frame outside said housing space and engaged with said rail means for permitting movement of said frame along said lateral path, whereby said shutter drive means are operable to raise said shutter from said charging hole to permit movement of said frame along said lateral path to bring said guide piece into a position of alignment between said transfer hopper and said charging hole.

2. The combination of claim 1 wherein said housing cover and housing bottom are horizontal and parallel to each other, said housing cover including edge flanges and angle irons connected to upper edges of said side walls and associated with said flanges for sealing said housing space.

3. The combination of claim 2 wherein said side walls have lower edges slidable over said housing bottom for sealing said housing space.

4. The combination of claim 3 wherein said shutter drive means comprises a spindle drive connected to said frame and including at least one spindle engaged with said shutter for lifting and lowering said shutter and a shifting drive engaged with said spindle drive for lifting and lowering said shutter and for moving said frame along said lateral path.

5. The combination of claim 4 including an immersion seal connected to said cooling pit around said housing cover and an immersion seal plate connected to said shutter and engaged in said immersion seal with said shutter closing said charging hole.

6. The combination of claim 5 wherein said shutter includes insulation material comprising a fire proof mat.

7. The combination of claim 1 wherein said shutter drive means comprises a spindle drive connected to said frame and including at least one spindle engaged with said shutter for lifting and lowering said shutter and a shifting drive engaged with said spindle drive for lifting and lowering said shutter and for moving said frame along said lateral path.

8. The combination of claim 7 including an immersion seal connected to said cooling pit around said housing cover and an immersion seal plate connected to said shutter and engaged in said immersion seal with said shutter closing said charging hole.

* * * * *